US005167851A

United States Patent [19]

Jamison et al.

[11] Patent Number: 5,167,851

[45] Date of Patent: Dec. 1, 1992

[54] HYDROPHILIC THERMALLY CONDUCTIVE GREASE

[75] Inventors: William L. Jamison, Fishers; Gary J. Larsen, Carmel; George E. Sears, Jr., Indianapolis, all of Ind.

[73] Assignee: Thermoset Plastics, Inc., Indianapolis, Ind.

[21] Appl. No.: 689,147

[22] Filed: Apr. 22, 1991

[51] Int. Cl.[5] ..... C09K 5/00; H02B 1/00

[52] U.S. Cl. ..... 252/74; 252/28; 252/572; 252/73; 361/386

[58] Field of Search ..... 252/572, 578, 579, 25, 252/28, 73, 74; 361/386

[56] References Cited

U.S. PATENT DOCUMENTS

| | | | |
|---|---|---|---|
| 3,405,066 | 10/1968 | McGhee et al. | 336/94 |
| 4,029,628 | 6/1977 | Fredberg | 524/361 |
| 4,265,775 | 5/1981 | Aakalu et al. | 210/222 |
| 4,299,715 | 11/1981 | Whitfield et al. | 252/74 |
| 4,416,790 | 11/1983 | Schürmann et al. | 252/28 |
| 4,422,962 | 12/1983 | Cichanowski | 252/73 |
| 4,466,483 | 8/1984 | Whitfield et al. | 165/185 |
| 4,473,113 | 9/1984 | Whitfield et al. | 165/185 |
| 4,518,513 | 5/1985 | Lochner et al. | 252/28 |
| 4,639,829 | 1/1987 | Ostergren et al. | 361/386 |
| 4,686,057 | 8/1987 | Lochner et al. | 252/28 |
| 4,756,851 | 7/1988 | Billigmeier et al. | 252/572 |
| 4,869,954 | 9/1989 | Squitieri | 428/283 |
| 5,094,769 | 3/1992 | Anderson, Jr. et al. | 252/71 |
| 5,100,568 | 3/1992 | Takahashi et al. | 252/28 |

OTHER PUBLICATIONS

"Materials/Processing Approaches to Phase Stabilization of Thermally Conductive Pastes", Anderson, Jr. and Booth, *IEEE Transactions on Components, Hybrids, and Manufacturing Technology*, vol. 13, No. 4, Dec. 1990.

Product advertisement/information sheet from Thermalloy, Inc., for Thermalcote II.

*Primary Examiner*—Prince Willis, Jr.
*Assistant Examiner*—James Silbermann
*Attorney, Agent, or Firm*—Barnes & Thornburg

[57] ABSTRACT

A water washable thermally conductive grease useful for thermal coupling of electronic chips and heat sinks in electronic modules comprises a hydrophilic liquid polymer carrier, an antioxidant, and up to 90 weight percent of a microparticulate thermally conductive filler. In a preferred embodiment, the thixotropic dielectric composition further comprises an ionic surfactant to promote wetting/dispersion of the microparticulate filler. The thermally conductive grease is non-corrosive, resistant to shear induced phase destabilization and capable of being washed from module surfaces with aqueous solutions. Substitution of the present hydrophilic based greases for art-recognized solvent washable greases eliminates use of non-aqueous solvents in electronic module processing/reprocessing operations.

11 Claims, No Drawings

HYDROPHILIC THERMALLY CONDUCTIVE GREASE

FIELD OF THE INVENTION

The present invention relates to thixotropic thermally conductive compositions useful for heat transfer in microelectronic devices. More particularly, this invention is directed to a hydrophilic thermally conductive dielectric grease which can be cleanly washed from the surfaces of electronic modules using aqueous solutions.

BACKGROUND OF THE INVENTION

Most electronic components, particularly solid state devices such as diodes, transistors and integrated circuitry, produce significant quantities of heat, and to maintain their reliable operation it is necessary to remove heat from the operating components. Numerous means of promoting heat dissipation from operating electronic components have been proposed in the art. The principal mode of heat transfer in many designs is conduction of generated heat to a heat sink, such as the device package and/or circuit board, which is itself cooled by convection and radiation. The effectiveness of such design depends critically on the efficiency of heat transfer between the device and the heat sink.

One of the most common means for thermally coupling heat generating chips and associated heat sinks is by application of a thermally conductive grease between the chip and the heat sink. Heat generated from the chip is efficiently conducted from the chip by the grease to, for example, a module cap, where the heat is thereafter dissipated by radiation and convection into the ambient surroundings.

Thermally conductive greases for heat transfer in electronic devices are well known in the art. Typically, they comprise a liquid carrier and a thermally conductive filler in combination with other ingredients which function to thicken the grease and remove moisture from the grease. Functionally thermal greases should exhibit high thermal conductivity, high thermal stability, and low surface tension to allow them to conform to the surface roughness and to wet heat transfer surfaces for maximizing the area of thermal contact. Further, the chemical makeup of thermal greases should be such that they are non-corrosive, electrically non-conductive and phase stable, i.e., non-bleeding and resistant to shear induced flocculation.

The liquid carriers utilized in most commercially available thermally conductive greases are mineral oils or, more commonly, silicone fluids. In combination with a thermally conductive filler, liquid silicones enable thermally conductive greases to meet each of the critical functional requirements for such products. Yet while silicone greases have generally functioned well, they have not been without disadvantage. One problem is phase separation (i.e. bleeding). Further, they are commonly known to contaminate equipment, work stations and users'clothing. That problem is exacerbated by the fact that many commercially available silicone-based thermal greases cannot be washed or removed except by the use of flammable aliphatic and aromatic hydrocarbons, or more commonly, the halogenated hydrocarbon solvents, including particularly freons. Indeed, removal of some of the commercially available silicone-based thermal greases requires the use of hot (70° -80° C.) polyhalogenated hydrocarbon solvents.

Because there has been significant scientific evidence of the adverse impact of halogenated hydrocarbons on the stratospheric ozone layer, there has been a nationwide, indeed a worldwide, effort to reduce emissions of such compounds by implementing control, conservation and alternative manufacturing methods. Indeed, environmentalists have demanded that use of such ozone depleting solvents be eliminated from all commercial manufacturing operations. Thus from the perspective of the electronics industry there is a significant need for development of a thermal grease which retains all of the requisite functional characteristics of the art accepted silicone-based greases including surface tension/viscosity, thermal conductivity, electrical non-conductivity, thermal stability, non-corrosiveness, and phase stability and at the same time be washable from component surface without the use of environment compromising solvents.

Accordingly, it is one object of this invention to provide a hydrophilic thermally conductive thixotropic dielectric composition for thermally coupling microelectronic components to heat sinks.

It is another object of this invention to provide a method for reducing the use of environment-compromising solvents in manufacture and rework of electronic components.

It is another object of this invention to provide a non-corrosive, thermally stable, thermally conductive dielectric grease that can be cleanly washed from all surfaces with aqueous wash solutions.

Those and related objects and advantages are obtained in accordance with this invention by utilization of a non-curing hydrophilic polymer as a liquid base for a novel, heat conductive, thixotropic dielectric.

SUMMARY OF THE INVENTION

There is provided in accordance with this invention a water washable, thermally conductive grease comprising a hydrophilic liquid polymer carrier, an antioxidant, and a thermally conductive filler. The thermally conductive grease of this invention exhibits all of the requisite functional characteristics for thermal coupling applications in electronic devices. Moreover, it can be removed advantageously from component surfaces and other surfaces contaminated with the grease by use of aqueous solutions, thereby eliminating a need for halogenated hydrocarbon solvent usage in electronic device manufacture and rework operations.

DETAILED DESCRIPTION OF THE INVENTION

In accordance with the present invention there is provided a thermally conductive, thixotropic dielectric which not only meets the viscosity, chemical/thermal stability, and phase stability specifications accepted for commercially available silicone based thermal greases, but most significantly, it can also be cleaned from circuit board/module surfaces without use of the flammable solvents or the chlorinated hydrocarbons and chlorinated/fluorinated hydrocarbon solvents now used extensively in the electronics industry. The thixotropic thermally conductive composition of this invention is formulated to exhibit sufficient hydrophilicity that it can be cleanly removed from any surface utilizing aqueous wash solutions.

The present compositions are in the form of a thixotropic grease or paste having a viscosity and surface tension that will allow it to conform to surface roughness and to wet the heat transfer surfaces to maximize the area of thermal contact and thereby minimize resistance to heat transfer.

The thermally conductive thixotropic dielectrics of the present invention comprise a hydrophilic liquid polymer carrier, an antioxidant, and a thermally conductive filler. In another embodiment the composition further comprises an ionic surfactant in an amount effective to promote wetting and dispersion of the thermally conductive filler.

Use of a hydrophilic liquid polymer carrier for the thermal grease of this invention offers several advantages It not only allows the present greases to be washed from surfaces with aqueous solutions, but the inherent high affinity of the mineral fillers and the hydrophilic polymer carrier allows high mineral loading (and thus high thermal conductivity) and enhanced phase stability over greases formulated with mineral oil or silicone fluid carriers.

The hydrophilic liquid carrier component of the thermally conductive dielectrics of the present invention are fluid polyols or polyethers having a molecular weight between about 400 and about 8,000, a hydrophilic/lipophilic balance of about 0.1 to about 8.0 and a viscosity between about 10 and about 10,000 centistokes, more preferably between about 20 to about 1,000 centistokes. Suitable hydrophilic liquid carriers for use in accordance with the present invention include poly($C_2$–$C_4$ alkylene) glycols, including particularly polyethylene glycol, polypropylene glycol, polybutylene glycol, ether-terminated derivatives of such polyalkylene glycols, mixed block polymers of such polyalkylene glycols, and other generally hydrophilic polyols/-polyethers recognized in the art as non-ionic, non-hygroscopic liquid polymers.

Another group of liquid carrier components suitable for use in the compositions of the present invention are the block polymers of polypropylene glycol and polyethylene glycol commercially available from BASF Wyandotte Corporation, Parsippany, N.J., sold under that company's trademark, PLURONIC®. Suitable Pluronic polyols include those having a poly(oxypropylene) component with a molecular weight ranging from about 950 to about 4,000 sandwiched between poly(oxyethylene) groups which constitute from about 10 to about 20 percent of the final molecule. Such compositions are non-hydroscopic and have a hydrophilic/lipophilic balance (HLB) between about 0.5 and about 8.

A preferred liquid carrier for use in the present composition is polypropylene glycol having a molecular weight between about 400 and about 4,000, more preferably between about 800 and about 2,000. One such carrier which has performed well in the present compositions is a polypropy glycol having an average molecular weight of about 1200 sold by Dow Chemical Company under the product name Polyglycol P-1200. Those skilled in the art will recognize, too, that the aforedescribed polyols/polyethers can be utilized in blended combinations as a liquid carrier for the thixotropic dielectrics of the present invention.

The thermally conductive filler component of the compositions of the present invention can be selected from those thermally conductive fillers that have been used in the art to enhance thermal conductivity of commercially available, silicone fluid-based thermal greases. Thus the thermal filler component can be selected from a wide variety of thermally conductive particulate, preferably microparticulate, compositions including alumina, silica (including silica fibers), aluminum nitride, silicon carbide, boron nitride, zinc oxide, magnesium oxide, beryllium oxide, titanium dioxide, zirconium silicate, clays, talcs, zeolites and other minerals. A non-abrasive thermal filler, such as zinc oxide, is preferred for formulating the present thixotropic dielectrics. Typically the thermally conductive filler is microparticulate powder having an average particle size ranging from about 1 to about 40 microns.

Use of the present thixotropic dielectrics as a thermal conductor in electronic devices, requires that the compositions exhibit good heat stability. Because the polyols/polyether liquid carrier components are more susceptible than the commonly utilized silicones to thermal degradation (oxidation) at elevated temperatures, it is important that the present compositions include an antioxidant in an amount effective to provide the requisite thermal stability. The thermally conductive grease of the present invention should exhibit a weight loss of less than 1 percent when held at 125° C for 24 hours. That stability specification can be met by incorporating into the present hydrophilic thermally conductive compositions, one or more antioxidants in an amount effective to retard polymer oxidation and its ensuing degradative effects. Suitable antioxidant components include primary antioxidants such as hindered phenolics and secondary amines, each of which are radical scavengers, and secondary antioxidants such as phosphites and thioesters which function as peroxide decomposers. There are many commercially available antioxidants sold particularly for polymer stabilization, including antioxidant formulations comprising synergistic combinations of primary and secondary antioxidants. Examples of commercially available antioxidants useful for formulating the compositions of the present invention include the Irganox® antioxidants available from Ciba Geigy, Vanox® antioxidants from R. T. Vanderbilt, and the Naugard® antioxidants available from Uniroyal Chemicals. Preferred antioxidants for use in the present formulation are blends of primary and secondary antioxidants, including particularly, blends of phenolic and phosphite antioxidant compositions.

If desired, a conventional wetting agent can be used in formulating the present invention to increase the amount of the thermally conductive filler powder that can be blended into the liquid carrier and still provide a composition having the requisite thixotropic properties. The wetting agent can be selected from those conventional wetting agents/surfactants well known in the art for Promoting dispersion of particulate fillers in polymer formulations. Preferred wetting agents for use in the present invention are polymeric ionic surfactants, most preferably, high-molecular weight polycharged systems, that preferentially associate with the surface of the dispersed particulate and thereby minimize the kinetic and attractive forces that tend to destabilize the particulate dispersion. Significant advantage has been obtained in formulating the present thixotropic dielectric formulations, particularly those employing the preferred zinc oxide thermal filler component, using a polyester surfactant with acid groups available from BYK-Chemie under the product name BYK-W 995. The wetting agent is used in a minimal amount, typically between about 0.05 and about 1 weight percent of the thermal grease composition, and it is added to the polyol/polyether liquid carrier component first to facilitate mixing and blending the thermal filler component into the composition.

In a preferred embodiment of this invention the thermally conductive composition of the present invention comprises about 10 to about 70 weight percent, more preferably 20 to about 35 weight percent, of the hydrophilic liquid carrier component; about 30 to about 90 weight percent, more preferably about 60 to about 80 weight percent, of the thermally conductive filler; and about 0.05 to about 2 weight percent, more preferably about 0.1 to about 0.5 weight, of the antioxidant. Since the thermal conductivity of the composition of the present invention is directly proportional to the loading of the thermal filler in the composition, it is preferred to utilize the maximum possible percentage of filler which can be blended with the hydrophilic liquid carrier and still provide a resultant composition having the requisite thixotropic properties.

The thixotropic dielectric composition of the present invention can be prepared using conventional mixing/-blending equipment. Preferably, compositions are prepared utilizing a conventional three-roll mill. Typically the liquid components, including the liquid carrier, the antioxidant, and optionally a wetting agent, are first blended and the resulting blend is combined with at least a major portion of the thermal filler and then blended on the three-roll mill. The remaining portion of the thermal filler is then added and blended into the composition by an additional three to ten passes on a three-roll mill.

The thixotropic thermally conductive dielectric compositions of the present invention can be applied to thermally couple heat sources and heat sinks using conventional means for applying thixotropic materials. For example, application can be by hand using a small spatula, or they can be applied from a compressible tube or injection nozzle or like means.

Advantageously, the present hydrophilic thermally conductive compositions can be cleaned from surfaces, for example, during rework of thermally coupled modules, utilizing aqueous solutions without use of the environmentally hazardous solvents which have been commonly employed in such rework operations to remove conventional silicone fluid based thermal greases.

The invention is further described with reference to the following working examples.

Thermal grease compositions A-E were formulated from ingredients indicated in Table 1 by first blending the polypropylene glycol component with the antioxidant and the wetting agent and thereafter blending the resulting carrier mixture with zinc oxide on a three-roll mill utilizing the number of passes indicated.

TABLE 1

| | THERMAL GREASE COMPOSITIONS | | | | |
|---|---|---|---|---|---|
| Ingredients (grams) | A | B | C | D | E |
| Polypropyleneglycol [Ave. M. Wt. ~ 1200] | 100 | 100 | 100 | 100 | 100 |
| BYK-W 995 | 1 | 1 | 1 | 1 | 1 |
| Irganox L-57 | — | 0.5 | 1 | — | — |
| Vanox 18887 | — | — | — | 0.5 | 1 |
| Zinc oxide (USP-2) | 200 | 200 | 200 | 200 | 200 |
| Passes on 3-roll mill | 3 | 3 | 3 | 3 | 3 |

Compositions A-E were compared for thermal stability by measuring weight loss at 125° after 16 and 40 hours. As shown by the data from Table 2, Composition C exhibited the best thermal stability.

TABLE 2

| Weight Loss (%) | A | B | C | D | E |
|---|---|---|---|---|---|
| 16 hours @ 125° C. | 23.8 | 0.39 | 0.43 | 0.43 | 0.48 |
| 40 hours @ 124° C. | 33.0 | 0.57 | 0.45 | 0.65 | 0.54 |

Compositions F-I (Table 3) were evaluated for their resistance to phase separation by centrifuging 10 gram samples of each of those compositions for 64 hours at 65° C. at an acceleration of 400 times the gravitational force. The resistance to phase separation is inversely proportional to the weight of "oil float" removed following centrifugation. As shown by the data in Table 4, Composition I exhibited the best resistance to phase separation.

Composition J (Table 3) was formulated and found to exhibit good stability and thermal conductivity characteristics.

TABLE 3

| | THERMAL GREASE COMPOSITIONS | | | | |
|---|---|---|---|---|---|
| Ingredients (grams) | F | G | H | I | J |
| Polypropyleneglycol [Ave. M. Wt. ~ 1200] | 100 | 100 | 100 | 100 | 100 |
| BYK-W 995 | 1 | 1 | 1 | 1 | — |
| Irganox L-57 | — | 0.5 | 1 | — | 1 |
| Vanox 18887 | — | — | — | — | — |
| Zinc oxide (USP-2) | 300 | 300 | 300 | 400 | 300 |
| Fumed silica | — | — | — | — | 2 |
| Passes on 3-roll mill | 10 | 5 | 1 | 5 | 3 |

TABLE 4

| | F | G | H | I |
|---|---|---|---|---|
| Start Weight (grams) | 10 | 10 | 10 | 10 |
| Finish Weight (w/oil removed) (grams) | 9.61 | 9.64 | 9.79 | 9.93 |
| Percent Oil Float 5646p | 3.9 | 3.6 | 2.1 | 0.7 |

We claim:

1. In a method for reversible thermal coupling of one or more operating components of an electronic device with an adjacent heat sink by selecting and applying a thermally conductive thixotropic composition in contact with both said operating components and said heat sink, the improvement which comprises selecting and applying a thermally conductive composition formulated as a water washable thermally conductive grease comprising about 10 to about 70 weight percent of a hydrophilic fluid carrier selected from the group consisting of a poly($C_2$-$C_4$ alkylene glycol) having a molecular weight between about 400 and about 4,000, ether derivatives thereof, and a block polymer of polypropylene glycol and polyethylene glycol having polyoxypropylene component with a molecular weight between about 950 and about 4,000 sandwiched between polyoxyethylene groups, about 30 to about 90 weight percent of a microparticulate thermally conductive filler, about 0.05 to about 1 weight percent of an ionic wetting agent and about 0.1 to about 2 weight percent of an antioxidant.

2. The improvement of claim 1 wherein the hydrophilic carrier is polypropylene glycol having a molecular weight between about 800 and about 2,000.

3. The improvement of claim 1 wherein the hydrophilic carrier is a block polymer of polypropylene glycol and polyethylene glycol having a hydrophilic lipophilic balance of about 0.5 to about 8.0.

4. The improvement of claim 1 wherein the ionic wetting agent is saturated polyester bearing acid groups.

5. The improvement of claim 1 wherein the microparticulate thermally conductive filler is zinc oxide.

6. In a method for reversible thermal coupling of one or more operating components of an electronic device with an adjacent heat sink by selecting and applying a thermally conductive thixotropic composition in contact with both said operating component and said heat sink, the improvement which comprises applying a water-washable thermally conductive grease in contact with said operating components and said heat sink, said thermally conductive grease comprising about 10 to about 70 weight percent of a hydrophilic fluid carrier;

about 30 to about 90 weight percent of a microparticulate thermally conductive filler; and about 0.05 to about 2 weight percent of an anti-oxidant.

7. The method of claim 6 wherein the hydrophilic carrier comprises a poly($C_2$–$C_4$ alkylene) glycol.

8. The method of claim 7 wherein the polyalkylene glycol has an average molecular weight of about 400 to about 8,000.

9. The method of claim 7 wherein the microparticulate thermally conductive filler is zinc oxide.

10. The method of claim 6 wherein the water washable thermally conductive grease further comprises about 0.05 to about 1 weight percent of an ionic wetting agent.

11. The method of claim 6 wherein the hydrophilic carrier is a block polymer of polypropylene glycol and polyethylene glycol having a hydrophilic/lipophilic balance between about 0.1 and about 8.0.

* * * * *